US005766415A

United States Patent [19]

Chen

[11] Patent Number: 5,766,415

[45] Date of Patent: *Jun. 16, 1998

[54] PROCESS FOR DELIGNIFICATION AND BLEACHING OF CHEMICAL WOOD PULPS WITH PEROXIDE AND DICYANDIAMIDE ACTIVATOR

[75] Inventor: Jianxin Chen, North Vancouver, Canada

[73] Assignee: Pulp and Paper Research Institute of Canada, Quebec, Canada

[ * ] Notice: The term of this patent shall not extend beyond the expiration date of Pat. No. 5,620,563.

[21] Appl. No.: 805,574

[22] Filed: Feb. 25, 1997

Related U.S. Application Data

[63] Continuation-in-part of Ser. No. 331,935, Oct. 31, 1994, Pat. No. 5,620,563.

[51] Int. Cl.[6] ..... D21C 9/16

[52] U.S. Cl. ..... 162/65; 162/72; 162/78

[58] Field of Search ..... 162/65, 72, 76, 162/79, 78, 80; 8/111; 252/106.28, 106.29, 186.39

[56] References Cited

U.S. PATENT DOCUMENTS

| | | | |
|---|---|---|---|
| 3,756,774 | 9/1973 | Kirner | 8/111 |
| 4,740,212 | 4/1988 | Yant et al. | 162/76 |
| 5,034,096 | 7/1991 | Hammer et al. | 162/65 |
| 5,620,563 | 4/1997 | Chen | 162/72 |

*Primary Examiner*—Steven Alvo

*Attorney, Agent, or Firm*—Shlesinger Arkwright & Garvey LLP

[57] ABSTRACT

A process of delignifying and bleaching a chemical wood pulp with hydrogen peroxide and dicyandiamide as an activator provides a higher degree of delignification and brightness of the pulp and overcomes problems of fibre degradation. The process comprises adding hydrogen peroxide and dicyandiamide as a bleaching activator to a chemical wood pulp slurry under alkaline conditions.

3 Claims, 2 Drawing Sheets

PROCESS FOR DELIGNIFICATION AND BLEACHING OF CHEMICAL WOOD PULPS WITH PEROXIDE AND DICYANDIAMIDE ACTIVATOR

This is a continuation of application Ser. No. 08/331,935 filed Oct. 31, 1994, now U.S. Pat. No. 5,620,563.

TECHNICAL FIELD

The present invention relates to bleaching and delignifying lignocellulosic materials such as wood and vegetable matter pulps, and more specifically to a bleaching and delignification process of pulp slurries using hydrogen peroxide or other peroxides as bleaching agents.

BACKGROUND ART

Cellulosic fibres are separated from wood or from other plant materials such as straw and bagasse, by a pulping process such as kraft or sulphite digestion. The resulting pulp still contains a significant amount of lignin and is generally dark coloured. In order to form pulp suitable for paper, a bleaching process is conducted on pulp slurries to remove the residual lignin, in other words, to delignify the pulp, and also brighten the dark coloured pulp.

Conventional bleaching processes such as CEDED, where C stands for chlorine bleaching, E for caustic extraction and D for chlorine dioxide, has in the past been practised by the pulp and paper industry. This process achieves certain brightness levels of pulps required for paper making. However, the use of chlorine and chlorine contained chemicals as bleaching agents is now considered to be environmentally unacceptable because large amounts of chlorinated organic materials are produced in the bleaching processes and difficulties arise in disposing of the used bleaching liquids.

In order to achieve the required brightness levels of pulps and eliminate the formation of chlorinated organics in the chemical pulp bleaching process, other chemicals than chlorine, chlorine dioxide or chlorine based chemicals are required as bleaching agents. Presently bleaching methods based on the use of oxygen, hydrogen peroxide and ozone have been developed and partially used in practice as a replacement for the chlorine based chemicals. Advantages of using these oxygen based bleaching chemicals are clearly beneficial from the point of view of environmental concerns, however, there are drawbacks and limitations with these methods which restrict their wide applications in pulp mills. For example, oxygen bleaching and delignification can only be applied to reach 40% to 50% reduction of the residual lignin content in lignocellulosic fibres, beyond which severe degradation of the cellulosic fibres occurs and pulp qualities deteriorate.

One disadvantage of hydrogen peroxide bleaching process is its ineffective action on lignin, even though it is known that hydrogen peroxide is a good brightening agent. If severe bleaching conditions such as high temperature are used in the peroxide bleaching stage, it leads to significant cellulose degradation.

Use of ozone, which is an delignifying agent, also results in severe fibre damage because of its intrinsic poor bleaching selectivity. Another disadvantage in ozone bleaching is that the process is uneconomical due to high capital expenditure for suitable equipment, and high processing costs. Thus, bleaching processes based on these oxygen based chemicals are not economical and do not achieve the same desired pulp qualities as those processes using chlorine based chemicals as bleaching agents.

Use of hydrogen peroxide to bleach chemical pulps, particularly oxygen delignified softwood kraft pulps, has been limited due to its weak bleaching action to remove residual lignin. Therefore, it is an aim of the present invention to provide a much improved hydrogen peroxide bleaching process for chemical pulp bleaching. It is known that increased reactivity of hydrogen peroxide through its conversion to other more reactive peroxy compounds leads to better peroxide bleaching performances. For example, the use of peracetic or peroxymonosulphuric acids, which can be generated from hydrogen peroxide, as a pulp bleaching agent is known.

Organic nitrites are known as activators for hydrogen peroxide or other peroxides. Reference is made to U.S. Pat. No. 2,927,840 to Dithmar et al and U.S. Pat. No. 3,113,951 to Williams et al. It is also known in the art that in textile bleaching, nitrile compounds such as cyanamide or its derivatives have been described as peroxide bleaching activators. Such examples can be found in U.S. Pat. No. 3,756,774 to Kirner et al, U.S.

Pat. Nos. 4,025,453 and 4,086,175 to Kravitz et al, U.S. Pat. No. 4,392,975 to Tourdot et al and U.S. Pat. No. 4,559,158 to Hase et al. Various nitrites are disclosed as being suitable for the purpose of peroxide activation, but no indication was disclosed for any given specific nitrile compound being more effective in the peroxide activation. Kirner et al and Kravitz et al (U.S. Pat. No. 4,025,453) both mention dicyandiamide, referred to as dicyanodiamide, being used as an activator for hydrogen peroxide under acidic conditions in the bleaching of textile materials. However, this is but one organic nitrile referred to in the patents and no advantage is shown for using this specific compound as compared to the other organic nitrile compounds. In fact, Kravitz et al demonstrates that the use of dicyandiamide is disadvantageous compared to that of cyanamide.

German Patent No. 4,004,364 to Sturm and U.S. Pat. No. 5,034,096 to Hammer at al both disclose processes for bleaching and delignifying lignocellulosic materials or pulps with peroxides and with activators of cyanamide or its salts. These references show that when cyanamide or its salts are added into the peroxide bleaching process, there is a significant improvement in the bleaching performance of sulphite pulps. Thus, increased delignification and brightness gain were achieved compared to that attained in peroxide bleaching processes without cyanamides.

The hydrogen peroxide bleaching processes where found to be less effective when applied to oxygen delignified softwood kraft pulps (see Sturm in 1993, Non-Chlorine Bleaching Conference) because oxygen delignified softwood kraft pulp is much more difficult to bleach. We have surprisingly found that whereas cyanamide used as an activator in the peroxide bleaching process is an improvement for some chemical pulps, in other cases the cyanamide was not beneficial but rather deteriorated the bleaching performance of hydrogen peroxide. This was particularly true on pulp brightness developments.

It is an object of the present invention to provide a process for delignifying and bleaching chemical pulps, particularly oxygen delignified softwood kraft pulps, with hydrogen peroxide or peroxides and with the use of more effective peroxide activators which avoids the disadvantages of known processes.

DISCLOSURE OF INVENTION

It has surprisingly been found that the use of dicyandiamide as an activator for hydrogen peroxide improves the bleaching of chemical wood pulps substantially. Dicyandiamide is sometimes referred to as cyanoguanidine, but throughout the application will be referred to dicyandiamide. A much higher degree of brightness and delignification for chemical wood pulps is achieved when this particular activator is used with hydrogen peroxide bleaching processes under alkaline conditions. This specific organic nitrile surprisingly has a much greater effect as an activator when used under alkaline conditions than other known types of organic nitrites, specifically cyanamide. While dicyandiamide has been used as one of many organic nitrites as an activator for hydrogen peroxide dyeing of textiles, it has not shown itself to be any better than other organic nitrites. However, in the case of wood pulps the superior bleaching improvements are spectacular and unexpected. The significant advantage of using dicyandiamide in the peroxide bleaching process compared to other nitrile compounds is unlikely to be attributed to the presence of the nitrile functional group only. The activator provides a novel and improved process for delignifying and bleaching of chemical wood pulps with hydrogen peroxide and/or other peroxides under alkaline conditions, preferably in the pH range of about 9 to 12. The preferred dicyandiamide quantity added to the bleaching process is in the range of about 0.05% to 6.0% by weight of oven-dry pulp.

The present invention provides a process of delignification and bleaching of chemical wood pulp comprising the steps of adding hydrogen peroxide together with dicyandiamide as a bleaching activator to a chemical wood pulp slurry under alkaline conditions. The process has significant advantages compared to existing peroxide bleaching processes. Greater delignification is achieved, together with improved brightness on chemical wood pulps, particularly oxygen delignified softwood kraft pulps. There is also provided a process of improved bleaching a chemical wood pulp to achieve a higher degree of delignification and brightness simultaneously without increasing degradation of cellulosic fibres, comprising the steps of adding hydrogen peroxide and dicyandiamide as a bleaching activator to a chemical wood pulp slurry under alkaline conditions.

BRIEF DESCRIPTION OF DRAWINGS

In drawings which illustrate embodiments of the present invention.

BEST MODE FOR CARRYING OUT THE INVENTION

Figure 1:
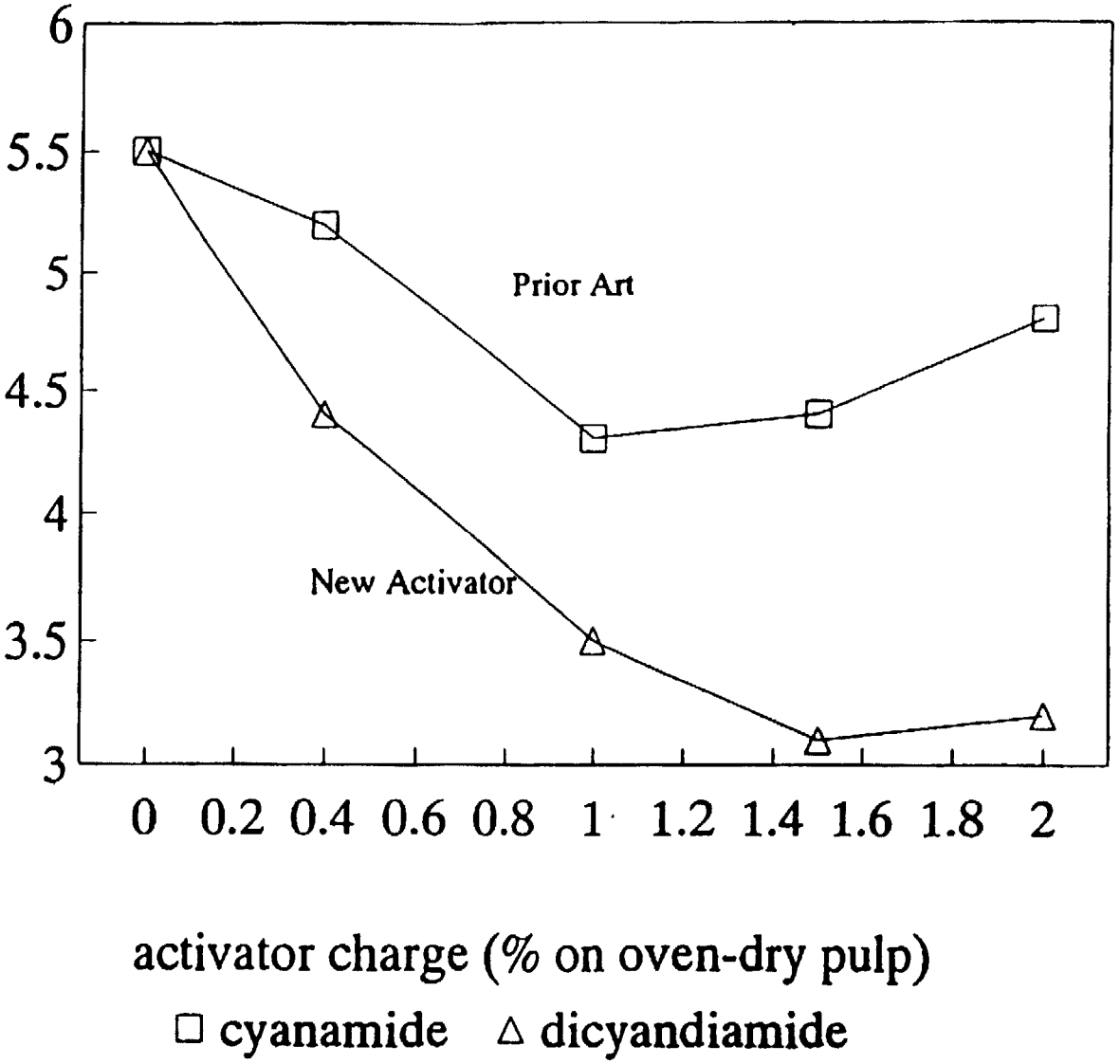
FIG. 1 is a graph showing a comparison of the Kappa numbers from tests of the existing activator with the activator of the present invention.

Canadian softwood kraft pulps, specifically oxygen-delignified softwood kraft pulps, are used in making pulp and paper and have been used in testing the present invention. Other chemical wood pulps for making paper include unbleached kraft and sulphite pulps from hardwood and softwood species. These pulps are also suitable for carrying out the present invention. Thus, the lignocellulosic materials which are referred to as pulps are suspended in an aqueous solution to form a slurry and are subjected to a pretreatment stage using a sequestering agent before the bleaching and delignification step.

It is known that certain transition metal ions, such as Mn(II), Fe(II and/or III) and Cu(II), which are naturally present in lignocellulosic materials are detrimental to hydrogen peroxide bleaching because these metal ions lead to undesirable decomposition of the peroxide, and at the same time, degradation of the cellulosic fibres occurs. Thus, pulps are commonly subjected to a pretreatment process where a sequestering or chelating agent, such as EDTA or DTPA is used to remove the metal ions. Such pretreatment stage is usually practised by adding an EDTA or DTPA charge of about 0.5% to 1% by weight of oven-dry pulp to a pulp slurry having a consistency of from about 1% to 5%. The pulp slurry is generally acidic having a pH between about 3 and 6 and the pretreatment occurs for about 30 to 60 minutes at a temperature of about 50° to 60° C.

After the sequestering or chelating treatment, the peroxide bleaching process occurs and hydrogen peroxide generally in an amount of from about 0.5% to 5.0% by weight of oven-dry pulp is added to the pulp slurry. An alkaline metal such as sodium hydroxide (caustic) is also usually added. The amount of the caustic used depends essentially upon the hydrogen peroxide charge and varies from about 0.5% to 4% by weight of oven-dry pulp. In addition, the caustic quantity is selected so that a desired alkaline condition is achieved. The pH of the bleaching solution is preferably in the range of about 9 to 12.

The amount of dicyandiamide used with the hydrogen peroxide depends primarily upon the charge of hydrogen peroxide and in one embodiment is found to be from about 0.05% to 6% by weight of oven-dry pulp and preferably an mount representing from about 30% to 70% by weight of the hydrogen peroxide charge. Thus, if the hydrogen peroxide content is in the range of about 0.5% to 5% by weight of oven dry pulp, then the preferred dicyandiamide content is in the range of about 0.15% to 3.5% by weight.

The peroxide stabilizing agent, such as EDTA or DTPA, and cellulose protecting agents such as magnesium salts, preferably magnesium sulphate, are known and commonly employed in the peroxide bleaching processes. These peroxide stabilizing and cellulose protecting agents are preferably mixed in the bleaching solution. In one embodiment about 0.2% by weight of oven-dry pulp of DTPA is added and about 0.05% to 0.1% by weight of oven-dry pulp of magnesium sulphate is added to the pulp slurry.

The aqueous pulp slurry is mixed with the stabilizing and cellulose protecting agents prior to bleaching so the final pulp slurry consistency before bleaching is kept at between about 2% and 30%, preferably between about 7% and 15%.

Bleaching temperatures can be varied in a wide range. The process according to the present invention is effective at temperatures from about 20° C. to 120° C., however the upper limit is dependent upon degradation of the cellulosic fibres not occurring. The preferred temperature range is between about 60° C. and 90° C. Higher bleaching temperatures generally lead to better bleaching action provided one can ensure that degradation of the cellulosic fibres does not occur.

The residence time for the bleaching step depends on the bleaching temperature, the pH, the pulp slurry consistency and the chemical charges in the bleaching solution. The residence time varies from about 1 minute up to 8 hours with a preferred time of from about 30 minutes to 4 hours.

In one embodiment of the process, the pulp slurry obtained from the sequestering pretreatment has a consistency in the range of about 10% to 30% and is mixed with peroxide stabilizing and cellulose protecting agents. The pH is subsequently adjusted by utilizing sodium hydroxide to a desired pH value, generally in the range of from about 9 to 12. The hydrogen peroxide and dicyandiamide are added in an aqueous solution of from about 1% to 70% by weight and preferably in the range of about 5% to 30% by weight. The pulp slurry is subsequently adjusted with water to a final consistency of about 7% to 15%. The bleaching action takes place at the preset temperatures which depend on the desired delignification and brightness. After bleaching the pulp slurry is subjected to a post-treatment stage in which the bleached pulp slurry is diluted to a low pulp consistency usually found to be about 0.5% to 2%, and the pH of the diluted pulp slurry is adjusted with an acid to 4 to 5 followed by subsequent dewatering and washing of the pulp.

The process may be applied to all chemical wood pulps such as unbleached kraft and sulphite pulps, oxygen delignified softwood and hardwood pulps and the like. Furthermore, the process may be applied as a pre-or post-bleaching stage for treatment of pulps. The process may be repeated in one bleaching sequence or in combination with other bleaching steps such as oxygen peroxides, ozone and/or chlorine dioxide.

The ISO brightness referred to in the examples is the determination of the bleach pulp samples as measured according to Canadian Standard test method—CPPA E1 and reported in % ISO units. The Kappa number is a measure of the lignin content of the cellulosic fibres and is measured by a bleachability test for pulps. The measurement is the number of milliliters of 0.1N potassium permanganate solution consumed by 1 g of oven-dry pulp according to TAPPI T-236-cm 85 method.

Viscosity is the degree of polymerization of cellulose and is determined according to CPPA G 24P method and reported in mpa.s.

For testing the invention, samples of 120 g of 0.3% by weight aqueous EDTA solution were mixed with 1,420 mL of deionized water. The resulting solution was adjusted to pH 3 by using a few drops of 20% sulphuric acid. 174 g (60 g oven-dry weight) of an oxygen delignified softwood kraft pulp were then mixed with the EDTA solution and the resulting pulp slurry had a pulp consistency of about 3.5%. The resulting slurry in a plastic bag was placed in a water bath at 50° C. for 30 minutes. After treatment the pH of the pulp slurry was about 4 to 5. The pulp slurry was filtered and washed.

EXAMPLE 1

115 g (30 g oven-dry weight) of the EDTA pretreated pulp were mixed with 0.06 g of DTPA (15 g of 0.4% aqueous solution) and 0.015 g of $MgSO_4$ (15 g of 0.1% aqueous solution) and subsequently with 0.51 g of NaOH (12.8 g of 4% aqueous solution) and 0.6 g of $H_2O_2$ (16 g of 3.8% aqueous solution). The resulting pulp slurry was diluted with 127 mL to about 10% pulp slurry consistency. The bleaching was carried out at 80° C. for 4 hours. The pH value after bleaching was 11.5. The bleached pulp slurry was then diluted with water to 2,000 mL and the pH of the diluted slurry was adjusted to 4.5 with sulphurous acid. Finally, the pulp slurry was filtered, washed and dewatered. The Kappa number, brightness and viscosity were determined and shown as Example 1 and may be compared with the unbleached pulp.

EXAMPLES 2 TO 5 (COMPARATIVE)

The same pulp, conditions and procedures as used for Example 1 were followed, except that after the addition of hydrogen peroxide, different quantities of cyanamide were added into the pulp slurry in the amount of 0.12 g (representing 0.4% by weight of oven-dry pulp), 0.30 g (representing 1% by weight of oven-dry pulp), 0.45 g (representing 1.5% by weight of oven-dry pulp), and 0.60 g (representing 2% by weight of oven-dry pulp). The cyanamide was dissolved in water before being added. The pH value after each bleaching was found to be in the order of 10 to 11. The bleached pulp slurry was subjected to the same post-treatment as in Example 1 and the Kappa number, brightness and viscosity determined as shown in Examples 2 to 5.

Figure 2:
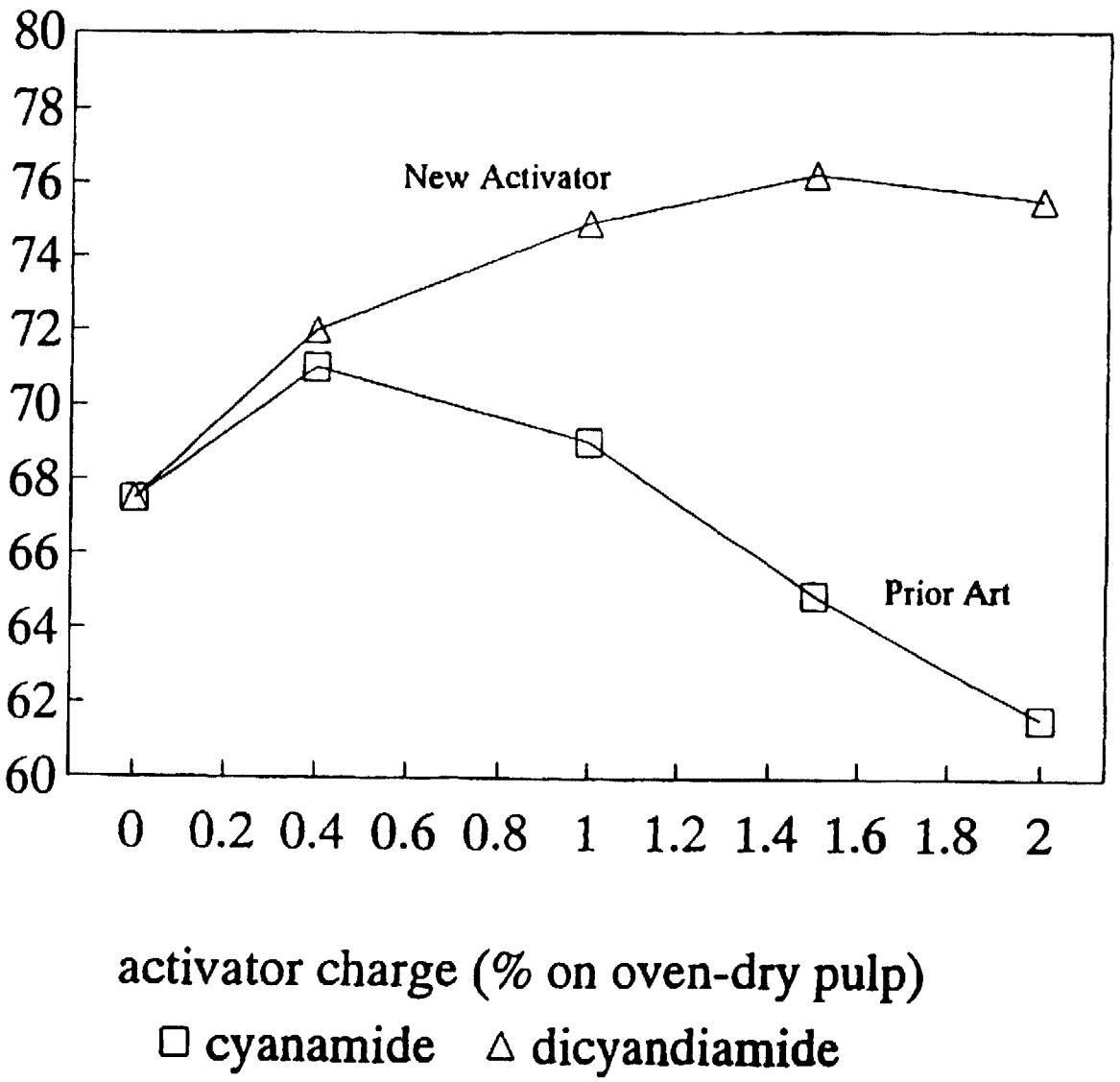
FIG. 2 is a graph showing a comparison of the brightness from tests of the existing activator with the activator of the present invention.

FIG. 1 shows the Kappa numbers taken from Table 1 for Examples 2 to 5 and FIG. 2 shows an initial minimal brightness gain occurring for kraft pulps with the known activator cyanamide. This minimal brightness gain is not considered to be sufficiently beneficial by the industry to justify the cost.

EXAMPLE 6 TO 9

The same pulp conditions and procedures as for Example 1 were followed except that after the addition of hydrogen peroxide, different quantities of dicyandiamide were added into the pulp slurry in the amount of 0.12 g (representing 0.4% by weight of oven-dry pulp), 0.30 g (representing 1% by weight of oven-dry pulp), 0.45 g (representing 1.5% by weight of oven-dry pulp), and 0.60 g (representing 2% by weight of oven-dry pulp). The dicyandiamide was dissolved in water before addition. The pH value after each bleaching was found to be in the order of 10 to 11 and the bleached pulp slurry was subjected to the same post-treatment as in Example 1. The Kappa number, brightness and viscosity are shown in Examples 6 to 9 in the following table.

TABLE 1

| | Activator Used | | | | |
|---|---|---|---|---|---|
| Example No. | Cyan-amide (wt %) | Dicyandi-amide (wt %) | Kappa number | Brightness (% ISO) | Viscosity (mPa · s) |
| unbleached | | | 11.4 | 36.7 | 25.1 |
| 1 | 0 | 0 | 5.5 | 67.5 | 19.0 |
| 2 | 0.4 | | 5.2 | 71.0 | 21.0 |
| 3 | 1.0 | | 4.3 | 69.0 | 20.5 |
| 4 | 1.5 | | 4.4 | 64.9 | 20.0 |
| 5 | 2.0 | | 4.8 | 61.6 | 20.0 |
| 6 | | 0.4 | 4.4 | 72.0 | 19.6 |
| 7 | | 1.0 | 3.5 | 74.9 | 18.7 |
| 8 | | 1.5 | 3.1 | 76.2 | 18.8 |
| 9 | | 2.0 | 3.2 | 75.5 | 18.7 |

The top line in the table represents the Kappa number, brightness and viscosity of unbleached pulp. Example 1 represents the pulp bleached by hydrogen peroxide without the addition of an activator. Examples 2 to 5 represent hydrogen peroxide bleaching with a cyanamide activator, and Examples 6 to 9 represent hydrogen peroxide bleaching with a dicyandiamide activator. As will be seen, the Examples 6 to 9 illustrate that the process of the present invention is far more effective on Kappa number reduction and brightness gain than that without any activator or with cyanamide. The viscosity of the treated pulp by the addition of the dicyandiamide activator has been maintained at the same level.

The improvement in Kappa number and Brightness comparing the new activator with the prior art activator is seen clearly in FIGS. 1 and 2.

EXAMPLES 10 to 12

A second oxygen-delignified softwood kraft pulp was used for these tests. The pulp was subjected to the same EDTA chelation pretreatment as the previous example.

77 g (20 g oven-dry weight) of the EDTA-pretreated pulp were mixed with DTPA (10 g of 0.4% aqueous solution) and $MgSO_4$ (10 g of 0.1% aqueous solution) and subsequently with certain amounts of NaOH and $H_2O_2$ which are specified as weight percentage on oven-dry pulp in the following Table 2. The resulting pulp suspension was diluted with water to about 10% pulp consistency. The bleaching was carried out at 80° C. for 4 hours. The pH value after bleaching was about 11 to 12. The bleached pulp suspension was then diluted with water to 2000 mL and the pH of the diluted pulp suspension was adjusted to 4.5 with sulphurous acid. Finally, the pulp was filtered, washed and dewatered. Kappa number, viscosity and brightness of the unbleached and bleached pulp samples are listed in Table 2.

EXAMPLES 13 to 15

The same pulp, conditions and procedures as in Examples 10 to 12 were followed, except that, after the addition of hydrogen peroxide, dicyandiamide was added into the pulp suspension in the specified amount (weight percentage on oven-dry pulp) as shown in Table 2. The pH value after bleaching was found to be about 10 to 11. The bleached pulp was also subjected to the same post-treatment as in Example 10. The bleaching results are given in Table 2.

TABLE 2

| Example No. | $H_2O_2$ (wt %) | NaOH (wt %) | Dicyandiamide (wt %) | Kappa number | Brightness (% ISO) | Viscosity (mPa · s) |
|---|---|---|---|---|---|---|
| unbleached | | | | 12.8 | 36.5 | 25.6 |
| 10 | 1.0 | 1.2 | 0 | 7.4 | 62.8 | 22.0 |
| 11 | 2.0 | 1.7 | 0 | 6.5 | 68.4 | 21.0 |
| 12 | 3.0 | 2.5 | 0 | 5.8 | 72.7 | 20.5 |
| 13 | 1.0 | 1.2 | 0.5 | 6.4 | 65.4 | 22.4 |
| 14 | 2.0 | 1.7 | 1.0 | 4.6 | 74.1 | 20.2 |
| 15 | 3.0 | 2.5 | 1.5 | 3.6 | 78.9 | 17.2 |

EXAMPLES 16 and 17

The same pulp, conditions and procedures as in Example 1 were followed, except that the bleaching time was 1 and 2 hours, respectively. The pH value after bleaching was found to be between 11 and 12. The bleached pulp was also subjected to the same post-treatment as in Example 1. The results are illustrated in Table 3.

EXAMPLES 18 and 19

The same pulp, conditions and procedures as in Examples 16 and 17 were followed, except that dicyandiamide was subsequently added into the pulp slurry in an amount of 0.3 g, which is about 1% by weight on oven-dry pulp. The bleaching time was also 1 and 2 hours, respectively. The pH value after each bleaching was found to be about 11 and 12. The bleached pulp was also subjected to the same post-treatment as in Example 1. The bleaching results are summarized in Table 3.

TABLE 3

| Example No. | Time (hour) | Dicyandiamide (wt %) | Kappa number | Brightness (% ISO) | Viscosity (mPa · s) |
|---|---|---|---|---|---|
| unbleached | | | 11.4 | 36.7 | 25.1 |
| 16 | 1.0 | 0 | 6.3 | 62.9 | 24.4 |
| 17 | 2.0 | 0 | 5.7 | 66.8 | 22.4 |
| 18 | 1.0 | 1.0 | 5.1 | 66.8 | 25.5 |
| 19 | 2.0 | 1.0 | 3.8 | 74.1 | 19.4 |

I claim:

1. An improved process for delignification and bleaching of an oxygen delignified chemical wood pulp comprising the steps of:

a) producing a slurry of chemical wood pulp under alkaline conditions; and b) adding to the slurry a hydrogen peroxide bleaching agent in a range of about 0.5% to 5% by weight of oven-dry pulp, and an effective amount of a dicyandiamide bleaching activator to produce a delignified and bleached wood pulp having a brightness value of about 72.5% ISO or greater and a kappa value of about 3.2 or less.

2. An improved process for delignification and bleaching of an oxygen delignified chemical wood pulp comprising the steps of:

a) producing a slurry of chemical wood pulp under alkaline conditions from the oven-dry pulp to be treated; and b) adding to the slurry a hydrogen peroxide bleaching agent in an amount of about 2% by weight of oven-dry pulp, and an effective abount of a dicyandiamide bleaching activator to produce a delignified and bleached wood pulp having a brightness value of about 72.5% ISO or greater and a kappa value of about 3.2 or less.

3. The process for delignification and bleaching according to claim 2 and wherein:

a) the dicyandiamide bleaching activator is about 50% by weight of the hydrogen peroxide bleaching agent added to the slurry.

* * * * *